US010801165B2

(12) United States Patent
Burns

(10) Patent No.: US 10,801,165 B2
(45) Date of Patent: Oct. 13, 2020

(54) RAIL SPIKE CLAW PULLER

(71) Applicant: Good Earth Tools, Inc., Crystal City, MO (US)

(72) Inventor: Raymond Burns, Bethalto, IL (US)

(73) Assignee: Good Earth Tools, Inc., Festus, MO (US)

( * ) Notice: Subject to any disclaimer, the term of this patent is extended or adjusted under 35 U.S.C. 154(b) by 604 days.

(21) Appl. No.: 15/291,922

(22) Filed: Oct. 12, 2016

(65) Prior Publication Data

US 2017/0030024 A1 Feb. 2, 2017

Related U.S. Application Data

(63) Continuation of application No. 14/452,313, filed on Aug. 5, 2014, now Pat. No. 9,637,867.

(51) Int. Cl.

| | |
|---|---|
| ***B25C 11/00*** | (2006.01) |
| ***E01B 29/26*** | (2006.01) |
| ***E01B 29/32*** | (2006.01) |
| ***B66F 15/00*** | (2006.01) |
| *E01B 13/02* | (2006.01) |

(52) U.S. Cl.

CPC ..... *E01B 29/26* (2013.01); *B25C 11/00* (2013.01); *B66F 15/00* (2013.01); *E01B 29/32* (2013.01); *E01B 13/02* (2013.01)

(58) Field of Classification Search

CPC ..... B25C 11/00; E01B 29/26; E01B 29/32; E01B 13/02; B66F 15/00

USPC ..... 254/25, 131, 21, 27, 18; 7/166, 151; 104/17.2, 2; D8/89

See application file for complete search history.

(56) References Cited

U.S. PATENT DOCUMENTS

| | | | |
|---|---|---|---|
| 125,325 | A | 4/1872 | Parkinson |
| 186,874 | A | 1/1877 | Prentice |
| 488,581 | A | 12/1892 | Smades |
| 524,082 | A | 8/1894 | Bjork |
| 1,053,599 | A | 2/1913 | Hess |
| 1,123,041 | A | 12/1914 | Wagner |

(Continued)

FOREIGN PATENT DOCUMENTS

| | | | |
|---|---|---|---|
| CA | 2522341 | A1 | 2/2007 |
| EP | 1041202 | A1 | 10/2000 |

(Continued)

OTHER PUBLICATIONS

Industry-Railway Suppliers, Inc. Work Equipment Parts Brochure.*

(Continued)

*Primary Examiner* — Monica S Carter
*Assistant Examiner* — Mahdi H Nejad
(74) *Attorney, Agent, or Firm* — Foley & Lardner LLP

(57) ABSTRACT

A spike claw puller for pulling a rail spike includes a handle that defines a through hole that is hole configured to couple to a rail spike pulling machine. A body section defines a top surface and comprises first and second feeder teeth that extend from the handle at a first lift and form a jaw opening therebetween configured to receive the rail spike. First and second feeder extensions extend from the first and second feeder teeth, where the first and second feeder extensions extend beyond a plane that is coplanar with the top surface. The first and second feeder extensions facilitate alignment with the rail spike.

18 Claims, 14 Drawing Sheets

(56) References Cited

U.S. PATENT DOCUMENTS

| | | | | |
|---|---|---|---|---|
| 1,317,156 | A | 9/1919 | Diamond | |
| 1,443,900 | A | 1/1923 | McCormick | |
| 1,454,239 | A | 5/1923 | Kawamura | |
| 1,481,131 | A | 1/1924 | Goben | |
| 1,650,096 | A | 11/1927 | Sarr | |
| 2,061,754 | A * | 11/1936 | Casey | E01B 29/26 254/25 |
| 2,087,148 | A | 7/1937 | Hempy | |
| 2,283,215 | A | 5/1942 | Lane | |
| 2,545,027 | A | 3/1951 | Grimm | |
| 2,900,169 | A | 8/1959 | White | |
| 3,406,412 | A | 10/1968 | Kottas | |
| 4,538,793 | A | 9/1985 | Dieringer et al. | |
| 4,649,613 | A | 3/1987 | Bednarik | |
| 6,530,434 | B1 * | 3/2003 | Grant | A01L 11/00 168/45 |
| 6,767,003 | B1 | 7/2004 | Toensing | |
| 7,090,196 | B1 * | 8/2006 | Linker | A61D 1/12 254/1 |
| 7,322,084 | B2 * | 1/2008 | Horsman | B25B 27/306 29/225 |
| 8,365,332 | B2 * | 2/2013 | Allen | B66F 15/00 254/18 |
| 2012/0199037 | A1 * | 8/2012 | Miller | E01B 29/26 104/2 |
| 2013/0263382 | A1 | 10/2013 | Sindt et al. | |
| 2015/0014612 | A1 * | 1/2015 | Liou | B25C 11/00 254/26 R |
| 2017/0144876 | A1 * | 5/2017 | Kasan | E04G 23/08 |

FOREIGN PATENT DOCUMENTS

| | | | |
|---|---|---|---|
| EP | 1612330 | A2 | 1/2006 |
| EP | 2426257 | A1 | 3/2012 |
| WO | WO-2015130147 | A1 | 9/2015 |

OTHER PUBLICATIONS

QMP Products Brochure, Part No. BTI-302955 (see p. 53) (BTI Spike Puller for common Rail Spikes, with Ribs and Radiused Guides Aiding Engagement); www.qmpltd.com.*

BTI Spike Puller (Ballast Tool Inc); www.qmpltd.com.*

Harsco Products—Nordco Machines (Year: 2015).*

Maintenance of Way Products Catalouge, Loftis_Robbins, Inc. http://www.railroadmow.com/maintenance-of-way-products-page-4.html.

Ballast Tools—Products | SP2R Spike Puller Nordco | BTI Spike Puller http://www.ballasttools.com/es/products/part/misc_equipment/23/581/4403.

BTI Spike Puller | Ballast Tools—Products | SP2R Spike Puller Nordco | BTI | Spike Puller http://www.ballasttools.com/es/products/part/misc_equipment/23/581/4403.

Spike Puller Claw; https:parts.harscorail.com/index.php?route=product/product&path=12&ptype=12&product_id=24552.

* cited by examiner

RAIL SPIKE CLAW PULLER

CROSS REFERENCE TO RELATED APPLICATIONS

This application is a continuation application of U.S. patent application Ser. No. 14/452,313, filed Aug. 5, 2014, now pending and incorporated herein by reference in its entirety.

FIELD

This disclosure relates to a spike claw puller and its method of manufacture.

BACKGROUND

A rail spike (also known as a cut spike or crampon) is a large nail with an offset head to keep railroad rails in gauge. In a rail line, a series of rail spikes secure the rails and a series of base plates to railroad ties located below the rails. Rail spikes are typically driven into the railroad ties with the rail spike body perpendicular to the railroad tie so that the offset head of the rail spike body contacts the base of the rail to hold the rail at a desired location.

In order to remove a rail spike from a railroad tie, tools such as a spike claw puller have been employed. A spike claw puller is a rail spike removal tool that engages the offset head of a rail spike and exerts an upward force on the head to pull the rail spike from the railroad tie. While previous spike claw pullers have been partially effective in the removal of rail spikes, previous spike claw pullers often have difficulty engaging the offset head of the rail spike and, thus, may not remove certain rail spikes in a spike pulling operation. In addition, previous spike claw pullers may partially engage the offset head of the rail spike, oftentimes tearing, shearing or otherwise breaking the offset head of the rail spike and leaving the remainder of the rail spike lodged in the rail tie.

SUMMARY

This disclosure presents an improved spike claw puller having slanted feeder extensions that guide the head and body of a rail spike into engagement with the spike claw puller to reduce instances of non-removal of a rail spike during a spike removal process and to allow for quick and easy engagement with a rail spike. The feeder extensions extend further from the handle section of the spike claw puller than the feet of previous spike claw puller designs to guide the spike claw puller into proper engagement with a rail spike. The feeder extensions also provide an increased surface area for engagement with the bottom side of the head of a rail spike to reduce the risk of the rail spike becoming disengaged from the spike claw puller or passing through the spike claw puller. The jaw opening of the spike claw puller includes a cradle that conforms to a bottom profile of the offset head of a rail spike. During operation, the spike claw puller provides for more effective removal of rail spikes and reduces instances of misalignment between the offset head and the spike claw puller to reduce non-removal of rail spikes during a spike removal operation.

In a general aspect, a spike claw puller for pulling a rail spike includes a handle that has an opening for coupling to a rail spike pulling machine. A first feeder tooth extends from the handle at a lift angle. A second feeder tooth extends from the handle at the same lift angle. The first feeder tooth and the second feeder tooth form a jaw opening. A cradle ends the jaw opening. The cradle is disposed between the first feeder tooth and the second feeder tooth. The cradle includes a concave profile that conforms to an underside of a head of the rail spike.

In one specific aspect, the first feeder tooth further includes a first rib for improving a first bending stiffness and the second feeder tooth further includes a second rib for improving a second bending stiffness.

In yet another specific aspect, the lift angle is about 42 degrees.

In one specific aspect, the cradle further includes a jaw opening that has a width of about 20.57 mm or 0.81 inches.

In one specific aspect, the concave profile conforms to the underside of the rail spike's head of ASTM A65 standard.

In a second general aspect, a method for manufacturing a spike claw puller for lifting a rail spike includes providing a die and a tool. The die and the tool together form a mold for a spike claw puller that includes a handle having an oblong opening. The spike claw puller further includes a first feeder tooth extending from the handle at a lift angle and a second feeder tooth extending from the handle at the lift angle. The second feeder tooth and the first feeder tooth form a jaw opening. A cradle ends the jaw opening and is disposed between the first feeder tooth and the second feeder tooth. The cradle includes a concave profile conforming to an underside of a head of the rail spike. The method further includes providing a work piece between the die and the tool. The work piece is forged into the spike claw puller. The work piece is then heat treated for obtaining proper mechanical properties.

In one specific aspect, the work piece is made of AISI 4340 alloy steel.

In another specific aspect, the first feeder tooth further includes a first rib for improving bending stiffness and the second feeder tooth further includes a second rib for improving bending stiffness. In some embodiments, the first and second feeder teeth both have a thickness of about 1 inch. In some embodiments, the first and second ribs both have a thickness of about 4 mm or 0.16 inches.

In one specific aspect, the lift angle of the first feeder tooth and the second feeder tooth is about 42 degrees.

In another specific aspect, the jaw opening has a width of about 0.81 inches.

In another aspect, there is presented a spike claw puller for pulling a rail spike that includes a handle, a first feeder tooth and a second feeder tooth. The handle has a feature for coupling the spike claw puller to a rail spike pulling machine and a first and second feeder teeth extend from the handle. The first feeder tooth and the second feeder tooth form a jaw opening therebetween to receive a rail spike. The first feeder tooth includes a first feeder extension and the second feeder tooth includes a second feeder extension to help align the spike claw puller with the rail spike.

In some embodiments, the first feeder extension includes a first slanted edge and the second feeder extension includes a second slanted edge to help align the spike claw puller with the rail spike.

In some other embodiments, the first slanted edge is located between a first leading edge of the first feeder extension and a first inner edge of the jaw opening, and the second slanted edge is located between a second leading edge of the second feeder extension and a second inner edge of the jaw opening.

In other embodiments, the first and second slanted edges are curved and have a radius of about 0.5 inches.

In some other embodiments, the first and second slanted edges are angular.

In yet other embodiments, the first feeder tooth includes a first rib and the second feeder tooth includes a second rib. The first rib extends from the first extension to an intersection of the handle with the first feeder tooth and the second rib extends from the second extension to an intersection of the handle with the second feeder tooth.

In another embodiment, the first and second feeder teeth have a thickness greater than a thickness of the handle.

In yet another embodiment, the jaw opening includes a cradle having a concave profile that is engageable with an underside of a head of a rail spike that conforms to ASTM A65 standard.

In some embodiments, the jaw opening includes a first inner edge and a second inner edge opposite from the first inner edge. In some embodiments, the first inner edge is parallel to the second inner edge.

In yet another aspect, there is presented a spike claw puller that includes a handle and a body that extends from the handle at a first lift angle. The body includes a first feeder tooth and a second feeder tooth and the first and second feeder teeth form a jaw opening therebetween. The first feeder tooth includes a feeder extension having a slanted edge to guide the spike claw puller into engagement with a rail spike and the second feeder tooth includes a feeder extension having a slanted edge to guide the spike claw puller into engagement with a rail spike.

In some embodiments, the jaw opening includes a first inner edge positioned opposite from a second inner edge. In some embodiments, the first inner edge is parallel to the second inner edge.

In other embodiments, the first feeder tooth includes a first rib for improving bending stiffness and the second feeder tooth includes a second rib for improving bending stiffness.

In still other embodiments, the first and second feeder extensions protrude at a second lift angle from the first and second feet, respectively, and the second lift angle is different than the first lift angle.

In yet other embodiments, the first and second feeder extensions have tapered ends to allow the first and second feeder extensions to fit within a distance between a head of a rail spike and a rail tie.

In yet another aspect, there is presented a spike claw puller that includes a handle that includes an opening; a first feeder tooth extending from the handle at a first lift angle; and a second feeder tooth extending from the handle at the first lift angle. The first tooth includes a first feeder extension and the second tooth includes a second feeder extension. The first and second feeder extensions extend from the first and second feeder teeth at a second lift angle.

In some embodiments, the first feeder extension has a first slanted edge and the second feeder extension has a second slanted edge to help align the spike claw puller with a rail spike.

In some embodiments, a jaw opening is positioned between the first feeder tooth and the second feeder tooth. In additional embodiments, the first slanted edge is located between a first leading edge of the first feeder extension and a first inner edge of the jaw opening and the second slanted edge is located between a second leading edge of the second feeder extension and a second inner edge of the jaw opening.

In still other embodiments, the feeder teeth have a thickness greater than a thickness of the handle.

In another embodiment, a cradle is located between the first and second feeder teeth, wherein the cradle has a concave profile conforming to an underside of a head of a rail spike.

In some embodiments, the first and second feeder teeth have feeder teeth bottom surfaces and the first and second feeder extensions have extension bottom surfaces that are coplanar with the feeder teeth bottom surfaces.

Other aspects, features and advantages will become apparent from the following detailed description when taken in conjunction with the accompanying drawings, which are part of this disclosure and which illustrate, by way of example, principles of the inventions disclosed.

DETAILED DESCRIPTION

Figure 1A:
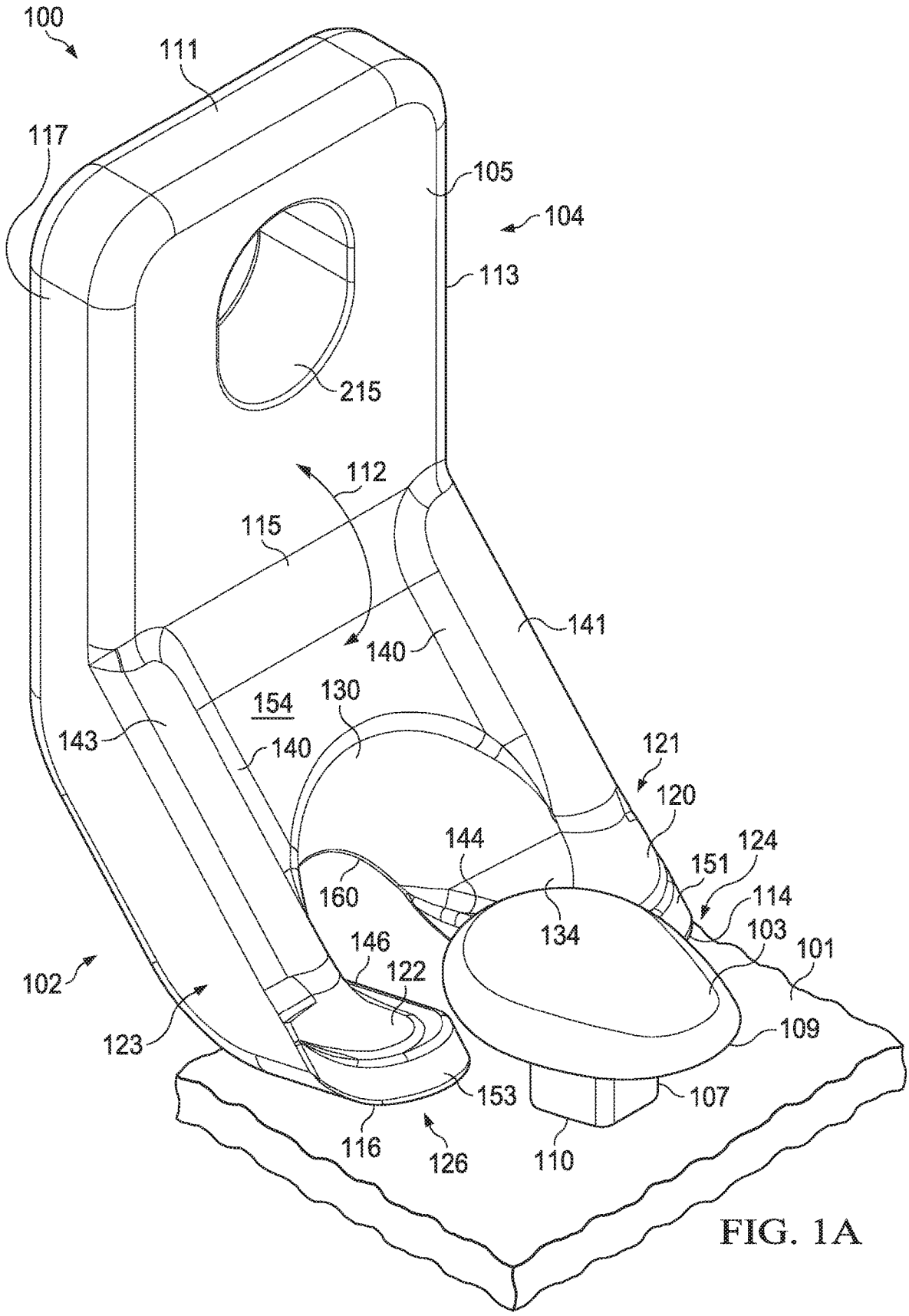
FIGS. 1A and 1B are perspective views illustrating a spike claw puller for use with a spike inserted into a surface.

FIGS. 1A-9 illustrate embodiments of a spike claw puller 100 that provides for more effective removal of rail spikes, such as rail spike 107. Referring specifically to FIGS. 1A and 1B, the spike claw puller 100 has feeder teeth 121 and 123 that include feeder extensions 120 and 122 that extend away from the feeder teeth 121 and 123 to help guide the spike claw puller 100 into engagement with the body 110 and the head 103 of the rail spike 107. The extensions 120 and 122 include slanted edges 151 and 153 (see also FIGS. 4A-4E) to assist in aligning the spike claw puller 100 with the rail spike 107. The feeder teeth 121 and 123 and the extensions 120 and 122 also include raised ribs 141 and 143 to help align the spike claw puller 100 with the head 103 of a rail spike 107 and to strengthen an intersection 115 between the body section 102 and the handle section 104 of the spike claw puller 100. The body portion 102 of the spike claw puller 100 includes a cradle 130 that conforms to the bottom profile 109 of the offset head 103 of the rail spike 107. The feeder extensions 120 and 122 include internal ledges 144 and 146 to provide for additional surface area adjacent to the cradle 130 to contact the bottom profile 109 of the rail spike 107 to reduce instances of the offset head 103 becoming dislodged from the cradle 130 or passing through the cradle 130 in a spike pulling operation. As such, the spike claw puller 100 provides for more effective removal of rail spikes 107 while reducing incidents of non-removal of a rail spike 107 or tearing, shearing or otherwise breaking the offset head 103 of the rail spike 107.

According to Applicant's knowledge, it was previously unknown by those skilled in the art that the design of previous spike pulling tools was actually reducing efficiency in removing rail spikes due to difficulties in aligning removal tools with rail spikes. It was also previously unknown that the design of previous spike pulling tools was causing problems associated with non-removal of rail spikes and breaking the offset heads of rail spikes. Applicant discovered that the design of previous spike pulling tools was causing non-removal of rail spikes and was making engagement between the pulling tool and the rail spike more difficult to obtain, thus reducing the efficiently of the rail spike removal process. In addition to discovering that these problems were associated with previous spike pulling tools, Applicant developed the spike puller 100 described herein, which reduces the number of non-removed rail spikes 107 in a removal operation and provides for easier alignment of the spike claw puller 100 with rail spikes 108.

Referring again to FIGS. 1A and 1B, the spike claw puller 100 includes a handle section 104 coupled to a body section 102. The handle section 104 includes a rectangular face 105 that includes an opening 215 or some other feature for coupling the spike claw puller 100 to a rail spike pulling machine (not shown). The rectangular face 105 includes three external sides: a first side 111, a second side 113 and a third side 117. In some embodiments, the second side 113 is parallel with the fourth side 117 and the first side 111 is parallel to an intersection 115 between the rectangular base 105 and the body section 102. In some embodiments, the intersection of the first side 111 and the second side 113, as well as the intersection of the first side 111 and the third side 117, form rounded right angle corners. In use, the handle section 104 couples to a machine for moving the spike claw puller 100 into engagement with a rail spike 107, such as the NORDCO "Spike Puller Two Rail," manufactured by Nordco of Oak Creek, Wis., USA. While the handle section 104 has a rectangular shape in the embodiments illustrated in FIGS. 1A-9, the handle section 104 may have any suitable shape in other embodiments.

Figure 4A:
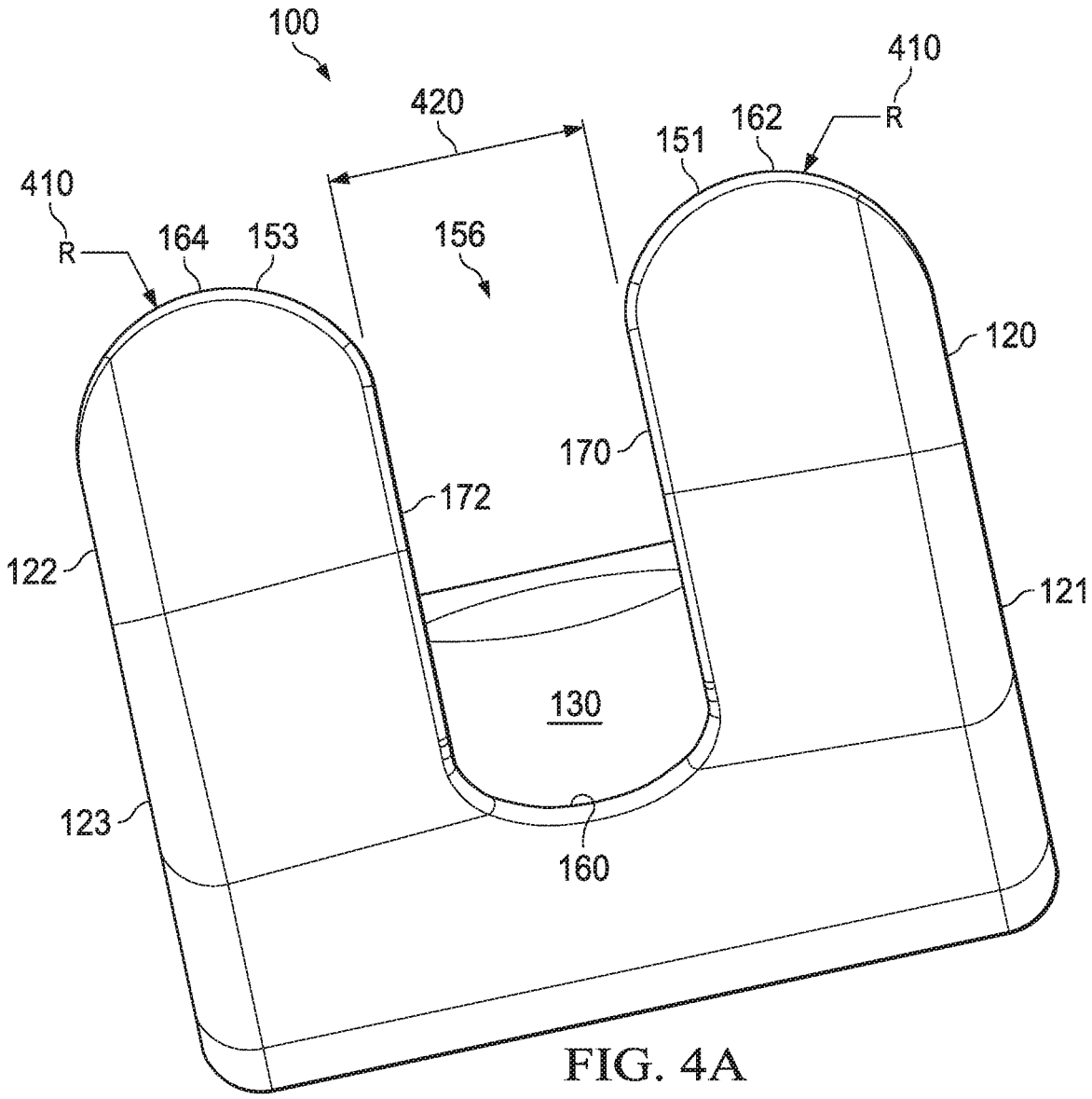
FIG. 4A is a bottom perspective view of the spike claw puller of FIG. 1 at view angle 4-4 of FIG. 3.
Figure 4B:
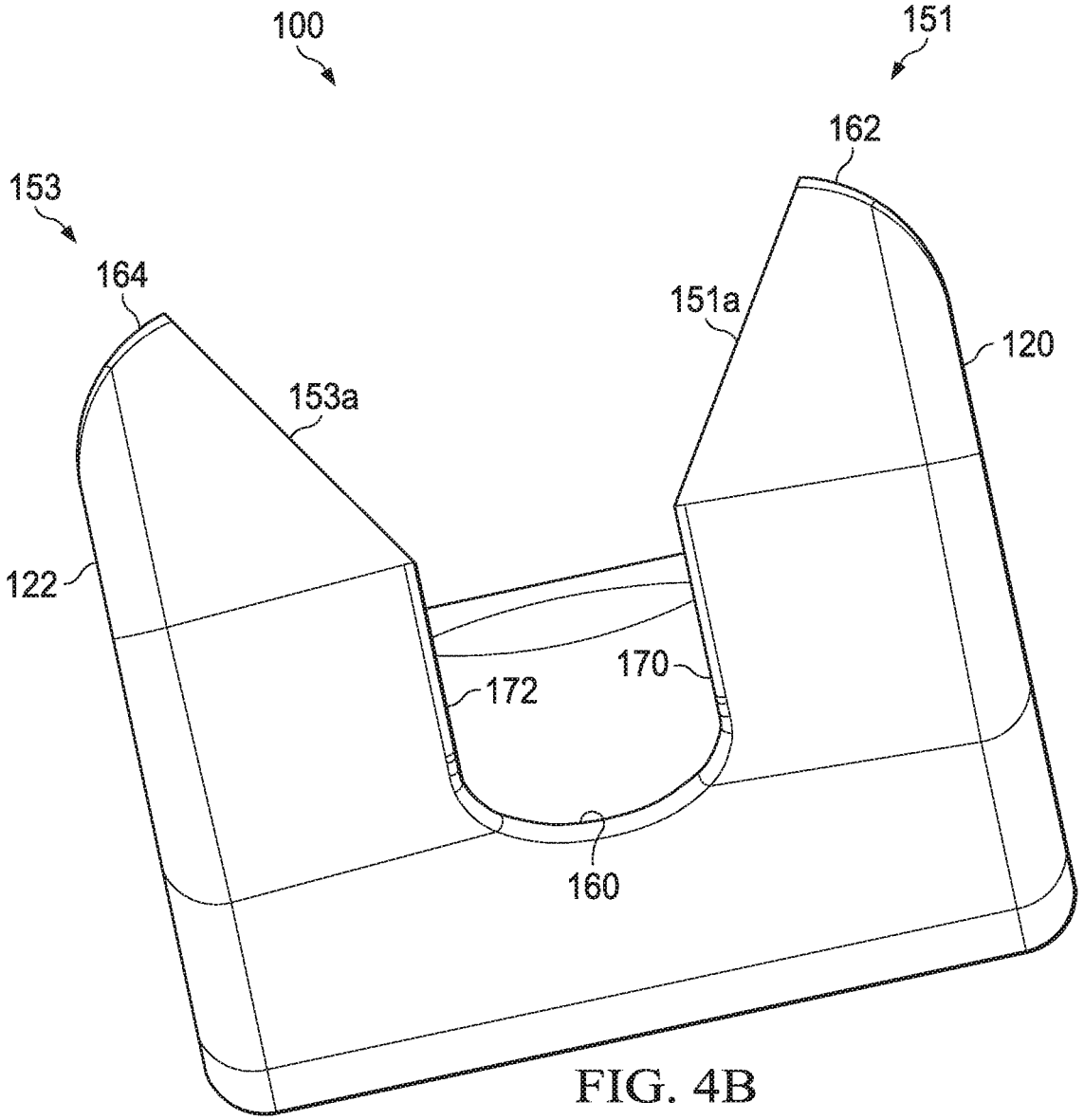
FIGS. 4B-4E are bottom perspective views of various embodiments of a spike claw puller.
Figure 4C:
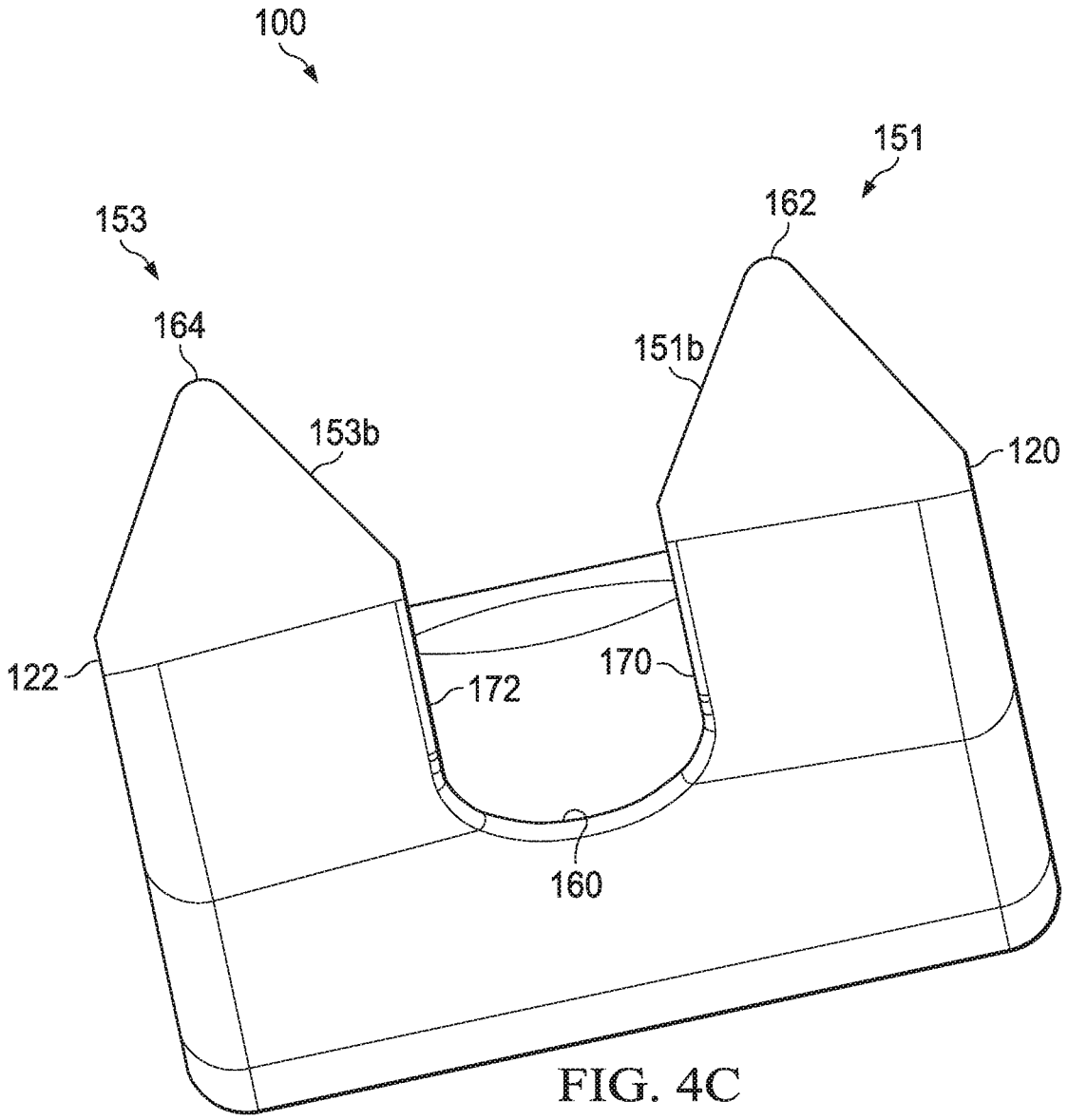
Figure 4D:
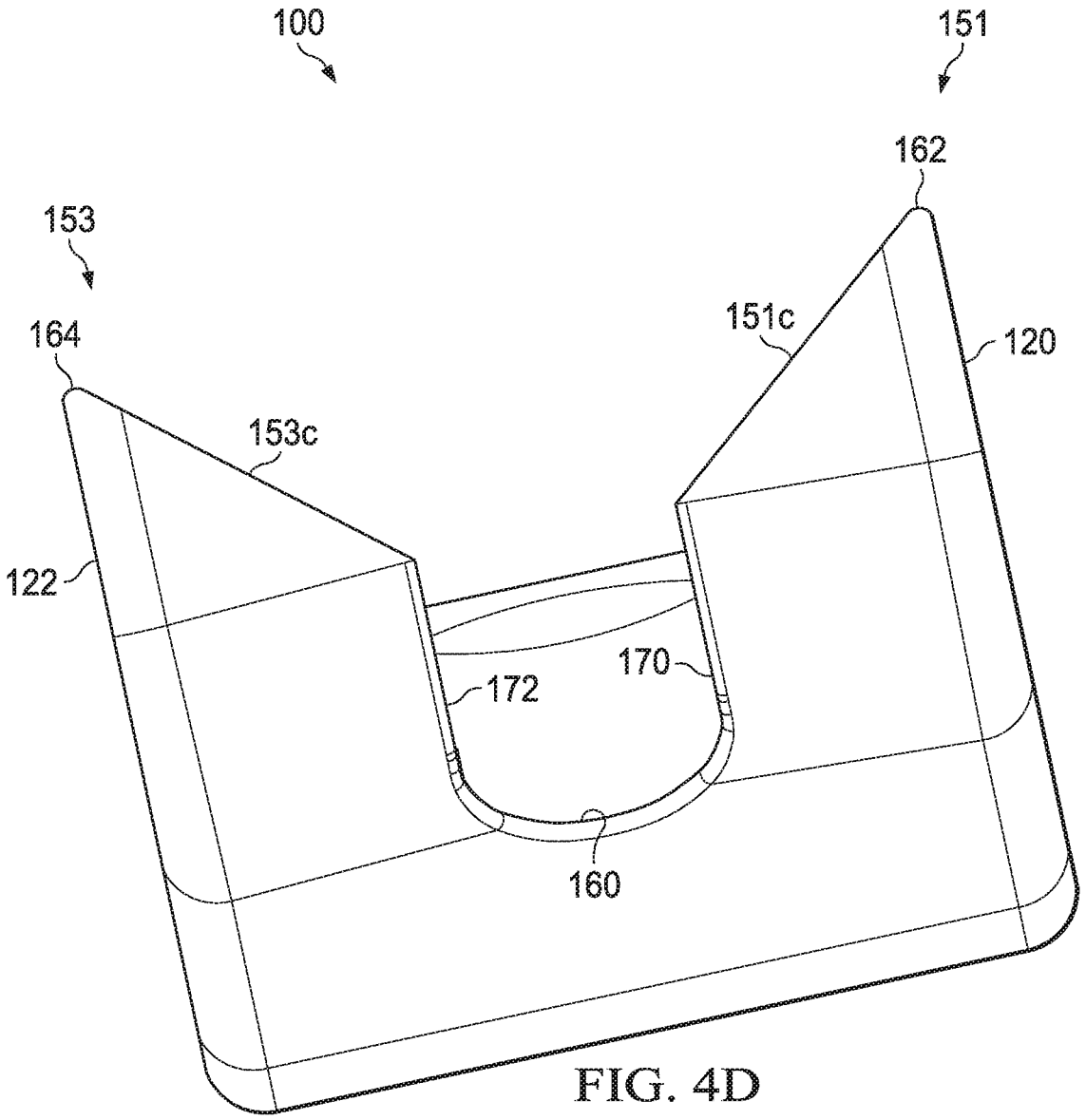
Figure 4E:
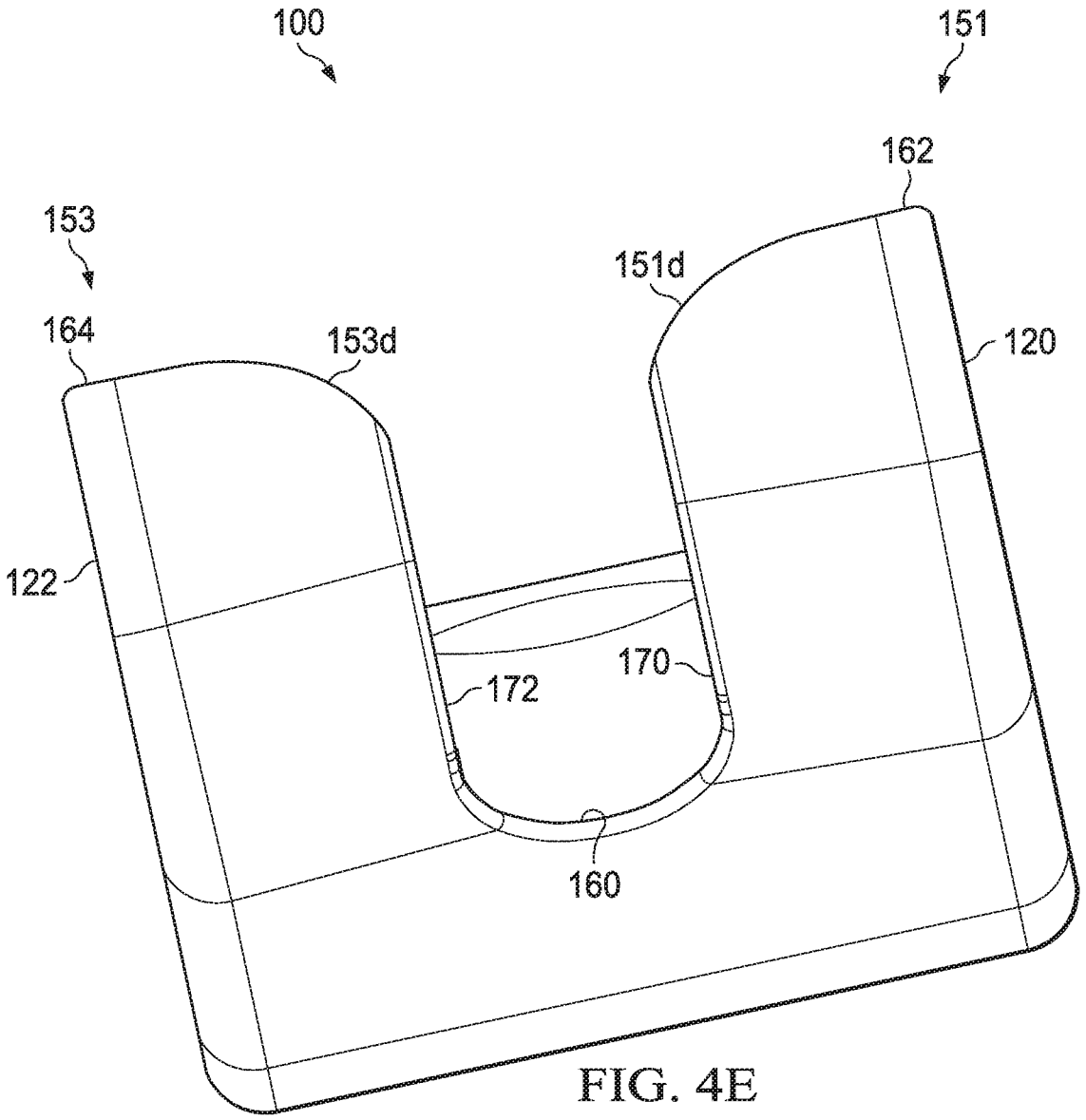

The body section 102 includes a first feeder tooth 121 and a second feeder tooth 123 separated by a cradle 130 and a jaw opening 160. The cradle 130 is located between the first feeder tooth 121 and the second feeder tooth 123 and includes a concave profile 134 that conforms to an underside 109 of the offset head 103 of a rail spike 107. For example, in some embodiments, the concave profile 134 conforms to the underside 109 of a head 103 of a rail spike 107 that conforms to the ASTM A65 standard. The jaw opening 160 is positioned between the first feeder tooth 121 and the second feeder tooth 123 to receive a nail portion 110 of the rail spike 107 so that the head portion 109 of the rail spike 107 engages the cradle 130. As shown in FIG. 4A, in some embodiments a first side wall 170 and a second side wall 172 of the jaw opening 160 are parallel to each other.

Referring again specifically to FIGS. 1A and 1B, in some embodiments the feeder extensions 120 and 122 include internal ledges 144 and 146 to increase a surface area of the spike claw puller 100 that contacts the underside 109 of the rail spike 107 to reduce the likelihood that the head 103 of the rail spike 107 passes through or disengages from the cradle 160 and/or the jaw opening 160.

The spike claw puller 100 further includes a first feeder tooth 121 and a second feeder tooth 123 that extend at an obtuse lifting angle 112 from the rectangular base 105. In some embodiments, the first feeder tooth 121 and the second feeder tooth 123 extend at the same lifting angle 112 from the rectangular base 105. In some embodiments, an outer edge of the first feeder tooth 121 is coplanar with the second side 113 and an outer edge of the second feeder tooth 123 is coplanar with the third side 117. In some embodiments, the first and second feeder teeth 121 and 123 include a first rib 141 and a second rib 143, respectively, for improving the bending stiffness of the spike claw puller 100 and for guiding or directing the head 103 of a rail spike 107 toward the cradle 130. The first rib 141 and the second rib 143 each include a tapered edge 140 (see also FIG. 9) to further direct the head 103 of the rail spike 107 toward the cradle 130. In some embodiments, the first rib 141 and the second rib 143 extend from the intersection 115 to the extensions 120 and 122 of the first feeder tooth 121 and the second feeder tooth 123, respectively.

Referring again to FIGS. 1A and 1B, the feeder extensions 120 and 122 of the first and second feeder teeth 121 and 123 each have slanted edges 151 and 153 to guide the spike claw puller 100 into engagement with the rail spike 107. The slanted edges 151 and 153 may be any suitable shape to guide the spike claw puller 100 into engagement with the rail spike 107. In the embodiments of FIG. 4A, for example, the slanted edges 151 and 153 are rounded and extend between the leading edges 162 and 164 of the first and second feeder extensions 120 and 122 and the interior edges 170 and 172 of the jaw opening 160. In other embodiments, the edges 151 and 153 of the extensions 120 and 122 may have any suitable shapes to guide the rail spike 107 into engagement with the spike claw puller 100. For example, FIGS. 4B-4E illustrate other shapes for the edges 151 and 153 of the feeder extensions 120 and 122 that guide the spike claw puller 100 into engagement with a rail spike 107. In the embodiment illustrated in FIG. 4B, for example, the edges 151 and 153 include straight surfaces 151*a* and 153*a* that extend between the leading edges 162 and 164 of the first and second feeder extensions 120 and 122 and the interior edges 170 and 172 of the jaw opening 160, respectively, to guide the spike claw puller 100 into engagement with a rail spike 107. In the embodiment illustrated in FIG. 4C, the edges 151 and 153 include slightly rounded surfaces 151*b* and 153*b* between the leading edges 162 and 164 of the first and second feeder extensions 120 and 122 and the interior edges 170 and 172 of the jaw opening 160 to guide the spike claw puller 100 into engagement with a rail spike 107. In the embodiment illustrated in FIG. 4D, the edges 151 and 153 include elongated, slanted surfaces 151*c* and 153*c* that extend between widely set leading edges 162 and 164 of the first and second feeder extensions 120 and 122 and the interior edges 170 and 172 of the jaw opening 160, respectively, to guide the spike claw puller 100 into engagement with a rail spike 107. In the embodiment illustrated in FIG. 4E, the edges 151 and 153 include large-radiused surfaces 151*d* and 153*d* located between the widely-set leading edges 162 and 164 of the first and second feeder extensions 120 and 122 and the interior edges 170 and 172 of the jaw opening 160, respectively, to guide the spike claw puller 100 into engagement with a rail spike 107. In other embodiments, the edges 151 and 153 of the feeder extensions 120 and 122 have other shapes that help to guide the spike claw puller 100 into engagement with the rail spike 107. This disclosure is not limited to the illustrated configurations of the edges 151 and 153 but rather encompasses other shaped edges 151 and 153 that guide the spike claw puller 100 into engagement with the rail spike 107.

Figure 3:
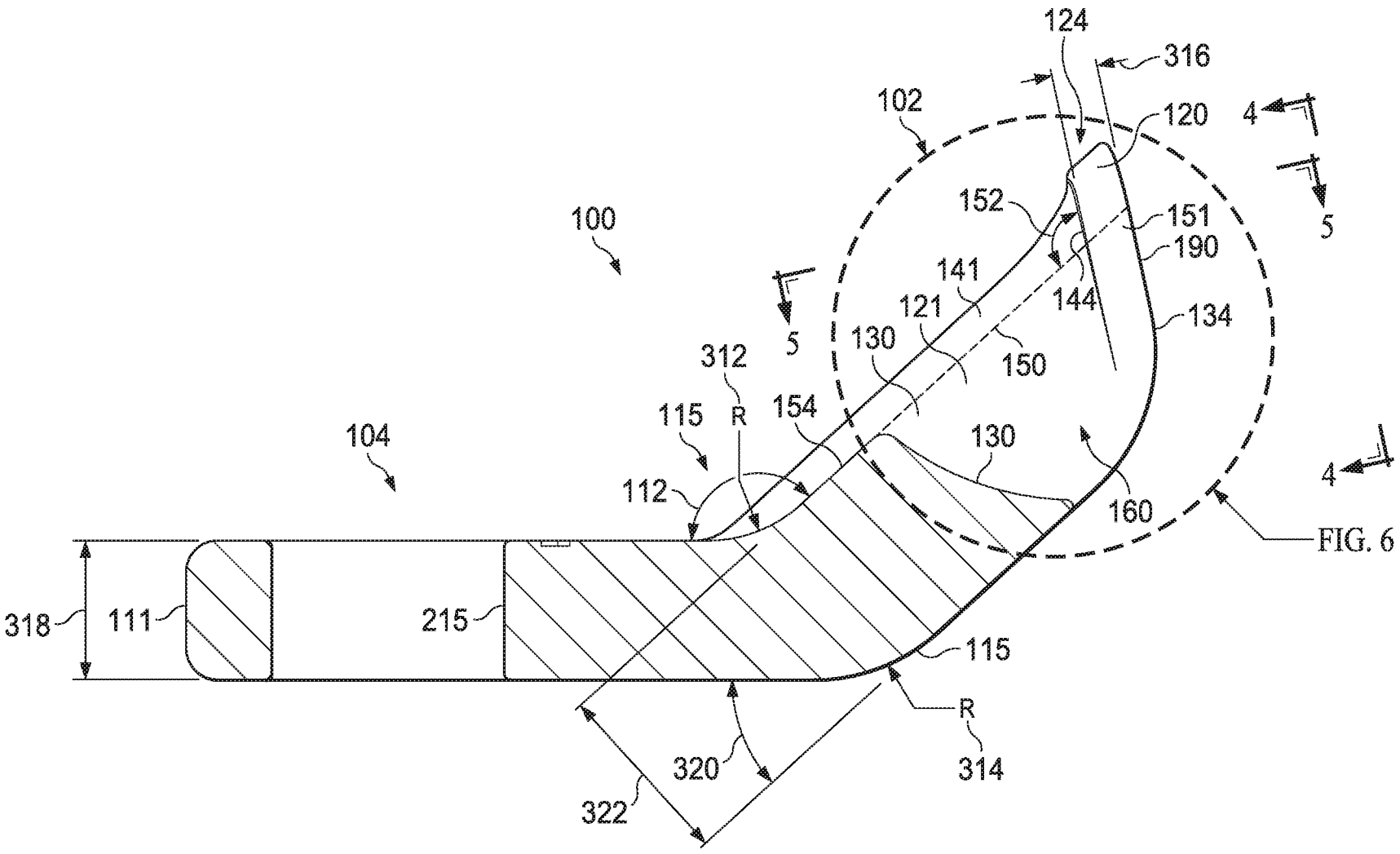
FIG. 3 is a cross-sectional side view of the spike claw puller of FIG. 1 taken at cross-section 3-3 of FIG. 2.
Figure 7:
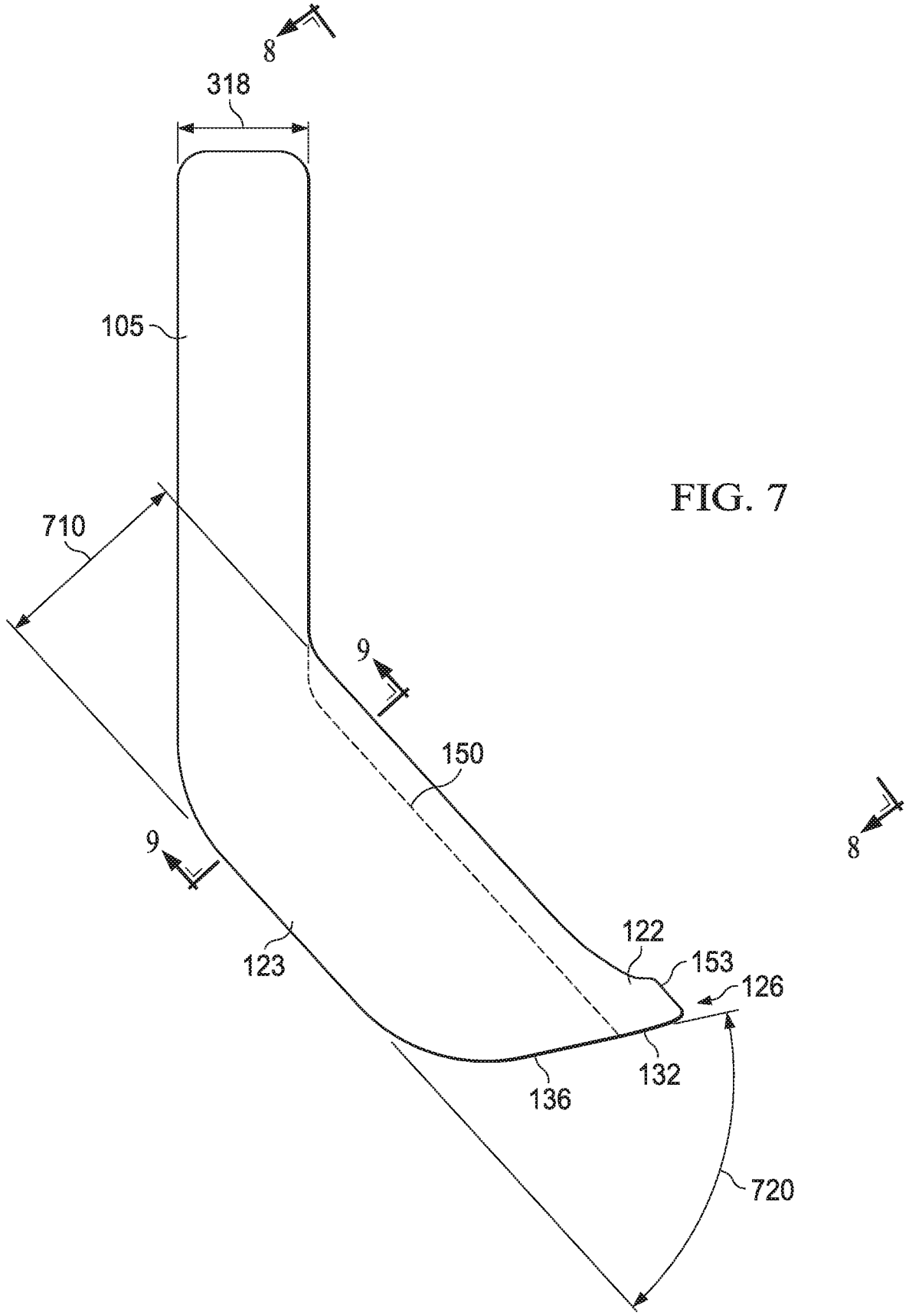
FIG. 7 is a side view of the spike claw puller illustrated in FIG. 1.

Referring specifically to FIGS. 3 and 7, the feeder extensions 120 and 122 and the ribs 141 and 143 protrude above a plane 150 of the top surface 154 of the body section 102. The feeder extensions 120 and 122 are positioned at a second lifting angle 152 from the plane 150 of the top surface 154 of the body section 102. In some embodiments, the second lifting angle 152 is different than the lifting angle 112 between the handle section 104 and the body section 102. Referring specifically to FIG. 3, the ledges 144 and 146 (ledge 146 is obscured from view in FIG. 3) of the feeder extensions 120 and 122 extend into the jaw opening 160 to increase a surface area that will contact the bottom profile 109 of the head 103 of a rail spike 107 when the spike claw puller 100 engages a rail spike 107. In some embodiments, bottom surfaces 190 and 132 of the feeder extensions 120 and 122 are coplanar with the bottom surfaces 134 and 136 of the feeder teeth 121 and 123, respectively.

Figure 1B:
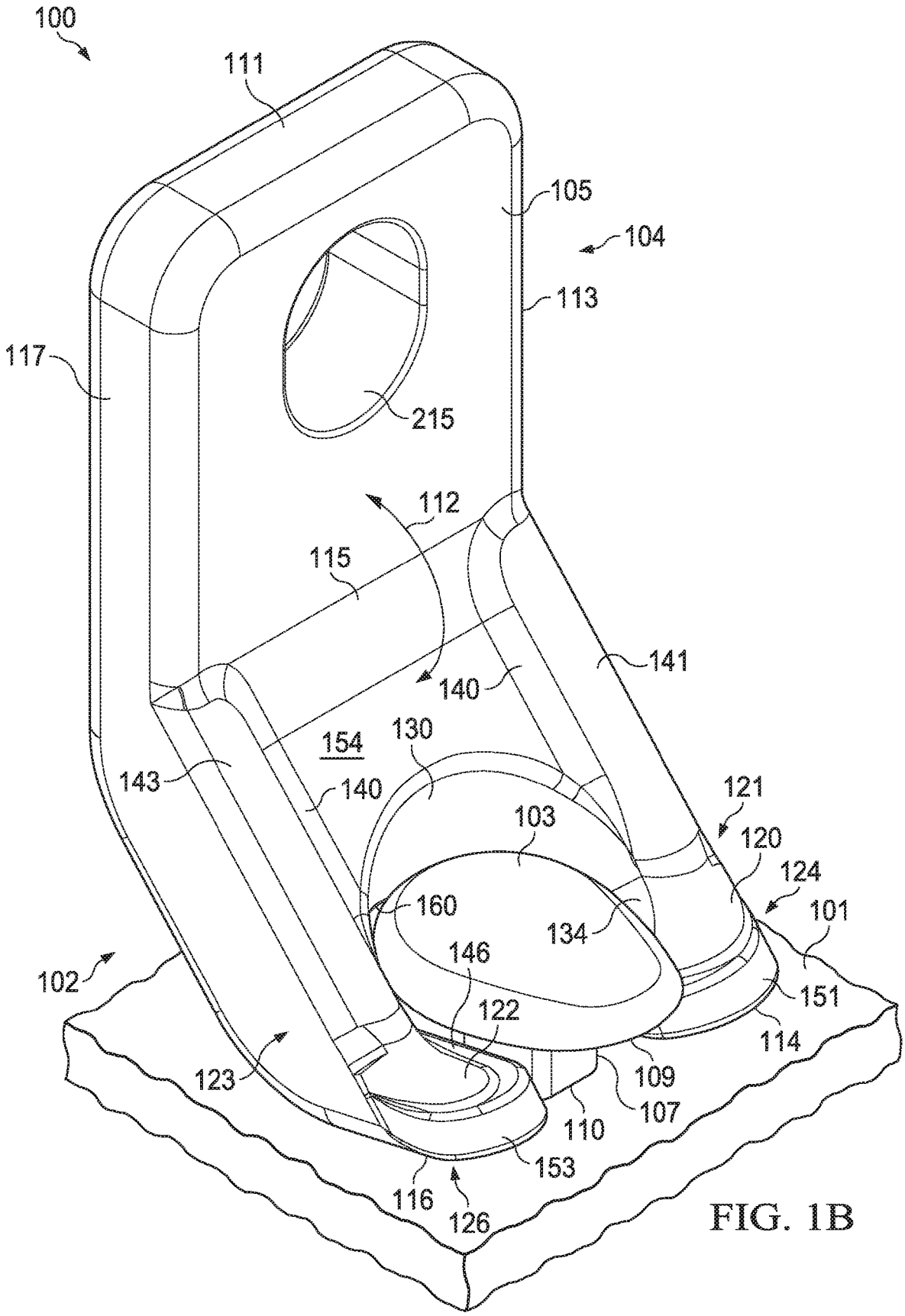

In some embodiments, the feeder extensions 120 and 122 are tapered toward the ends 124 and 126 to allow for insertion of between the head 103 of a rail spike 107 and a surface 101, such as a rail tie. During operation, the ends 124 and 126 are inserted into a space between the offset head 103 of the rail spike 107 and the surface 101 underneath for convenient removal of the rail spike 107. For example, FIG. 1B illustrates the spike claw puller 100 and the spike 107 wherein the ends 124 and 126 of the extensions 120 and 122 are located between the offset head 103 and the surface 101. A bottom profile 109 of the offset head 103 will contact the concave profile 134 of the cradle 130 and the internal ledges 144 and 146 as the spike claw puller 100 is pulled away from the surface 101. The extensions 120 and 122 are insertable into the clearance between the bottom profile 109 of the rail spike 107 and the surface 101 and help guide the nail portion 110 of the rail spike 107 into the jaw opening 160 and the head 103 of the rail spike 107 into the cradle 130.

Figure 2:
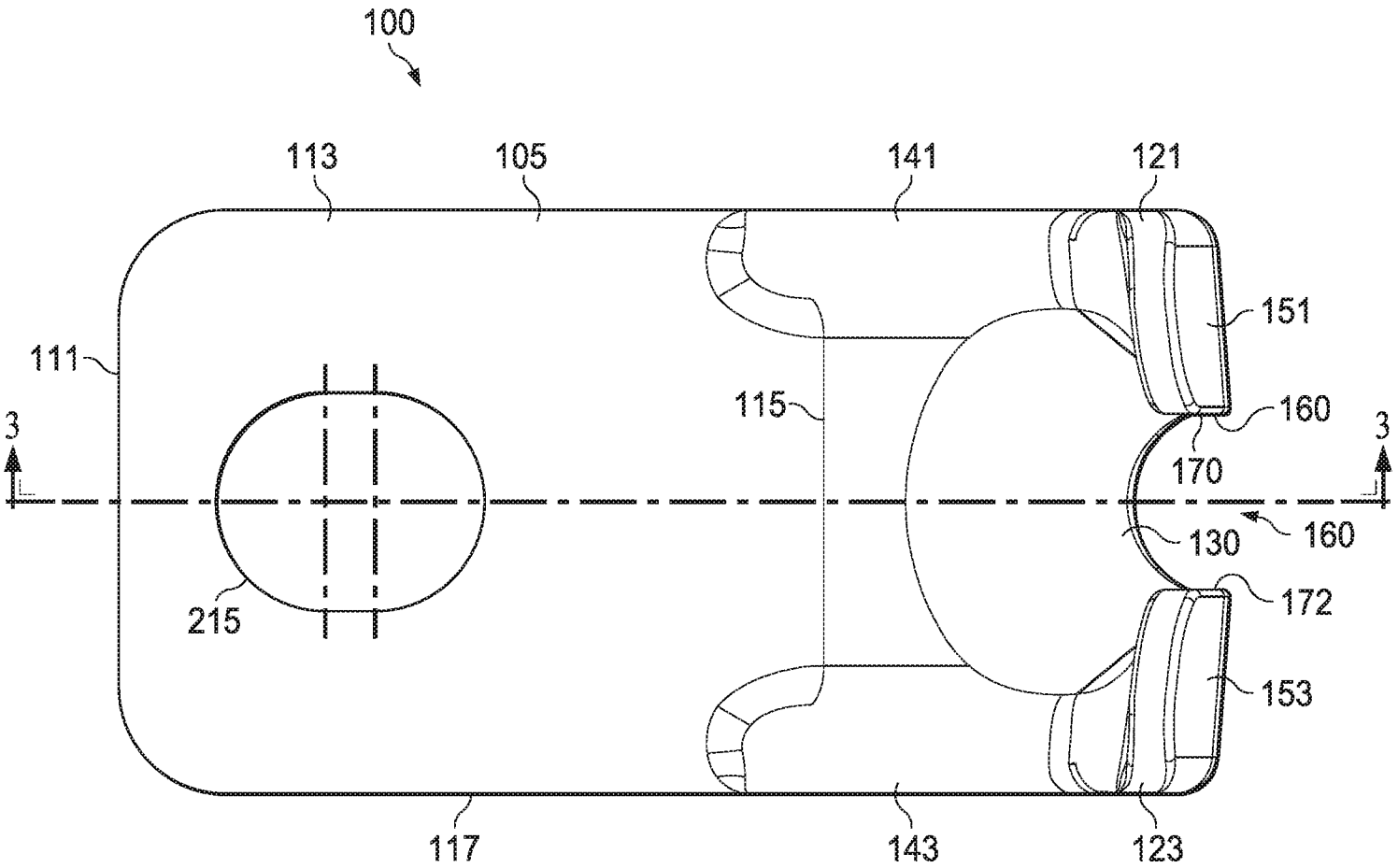
FIG. 2 is a front view of the spike claw puller of FIG. 1.

FIG. 2 is a front view of the spike claw puller 100 of FIG. 1. As described above, the rectangular base 105 includes an opening 215 or some other feature to allow the spike claw puller 100 to be installed onto another machine or mechanism. The opening 215 may be oblong in shape. As shown in the embodiment illustrated in FIG. 2, the spike claw puller 100 is symmetric about a central axis at line 3-3.

FIG. 3 is a cross-sectional side view of the spike claw puller 100 at cross-section 3-3 shown in FIG. 2. In some embodiments, the thickness 322 of the body section 102 is greater than the thickness 318 of the handle section 104 to increase the strength of the spike claw puller 100 and to reduce the incidence of the spike claw puller 100 breaking at the intersection 115. The angle 320 between the handle section 104 and the body section 102 may be about 42 degrees and the lift angle 112 between the feeder teeth 121 and 123 and the handle section 104 is obtuse and may be about 138 degrees. The transition radius 312 may be about 19 mm or 0.75 inches. The external rounding radius 314 may be about 25.4 mm or 1 inch. The ledge thickness 316 of the first and second internal ledges 144 and 146 may be about 6.35 mm or 0.25 inches. In some embodiments, the dimensions described above provide for more precise mating of the spike claw puller 100 with a rail spike 107 to reduce instances of non-removal of a spike 107 during a spike removal process and may provide for increased structural strength for the spike claw puller 100.

FIG. 4A is a bottom perspective view of the spike claw puller 100 shown at view angle 4-4 of FIG. 3. In the embodiment illustrated in FIG. 4A, the width 420 of the jaw opening 160 is uniform from an entrance 156 to the jaw opening 160 to the cradle 130 and is configured to be slightly larger than an average width of a nail portion 110 of a rail spike 107. In some embodiments, the width 420 of the jaw opening 160 is about 0.83 inches. In some embodiments, a first side wall 170 of the jaw opening 160 is parallel to a second side wall 172 of the jaw opening 160.

In some embodiments, the feeder extensions 120 and 122 have rounded edges 151 and 153 with a rounding radius 410 of about 0.5 inches. In other embodiments, the rounded edges 151 and 153 have a rounding radius 410 of about 12 mm or 0.48 inches. As described above, the extensions 120 and 122 can have any other suitable shape that guides the spike claw puller 100 into engagement with the rail spike 107, such as, but not limited to, the shapes illustrated in FIGS. 4B-4E, as described above.

Figure 5:
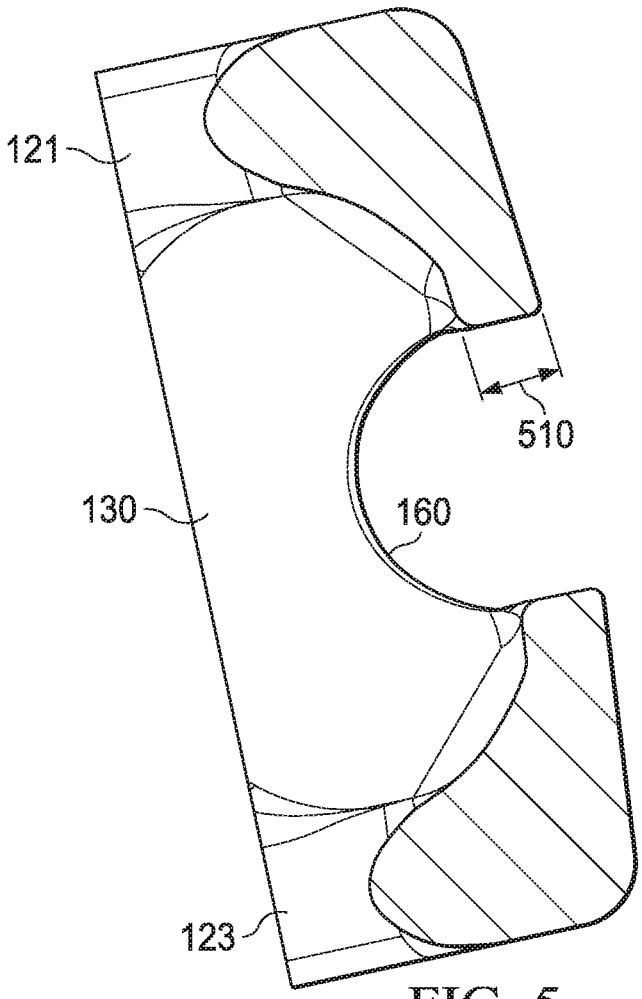
FIG. 5 is a detailed cross-sectional view of the spike claw puller of FIG. 1 taken at section 5-5 of FIG. 3.

FIG. 5 is a detailed cross-sectional view of the spike claw puller 100 at the section 5-5 shown in FIG. 3. In some embodiments, the thickness 510 of the first and second feeder teeth 121 and 123 at the position shown adjacent to the jaw opening 160 is about 6.2 mm or 0.243 inches. The above-described dimensions may provide for sufficient structural strength to remove rail spikes 107 by applying an upward force to the bottom profile 109 of the rail spike 107.

Figure 6:
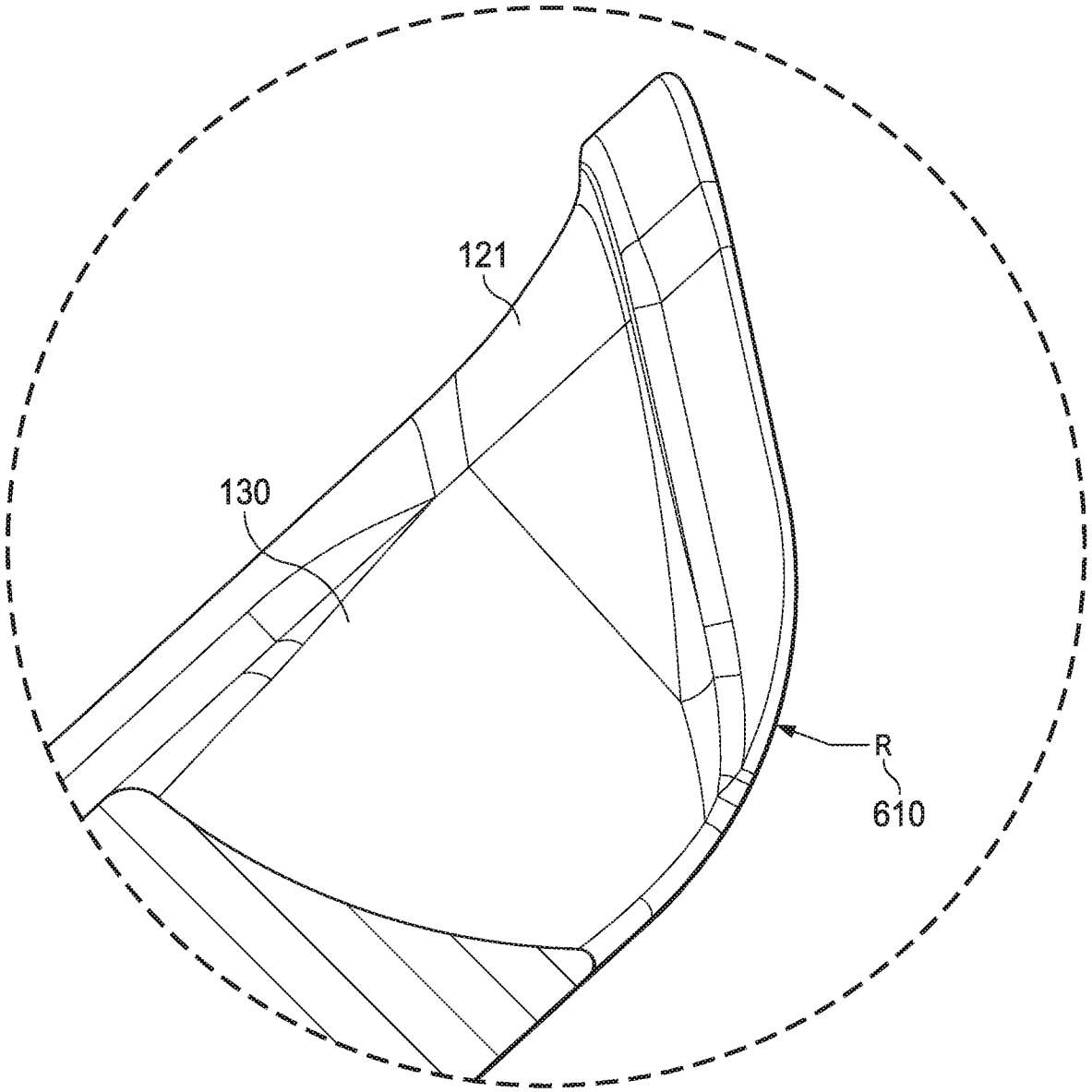
FIG. 6 is a detailed cross-sectional view of the spike claw puller of FIG. 1 taken at detail 6 of FIG. 3.

FIG. 6 is a detailed view of the portion of FIG. 3 labeled "6". The rounding radius 610 of the first feeder tooth 121 may be about 25.4 mm or 1 inch. The rounding radius 610 provides for movement and rotation of the spike claw puller 100 into engagement with a head 103 of a rail spike 107 as the rail spike 107 is coupled to a rail tie 101. The second feeder tooth 123 may have the same radius 610.

FIG. 7 is a side view of the spike claw puller 100 shown in FIG. 1. In some embodiments, the thickness 710 of the body section 102 together with the ribs 141 and 143 is about 29.5 mm or 1.16 inches and the thickness of the handle section 104 is about 19 mm or 0.75 inches. The feeder angle 720 may be about 60 degrees. The feeder angle 720, in conjunction with the rounding radius 610 (FIG. 6) provide for rotation of the spike claw puller 100 into engagement with a head 103 of a rail spike 107.

Figure 8:
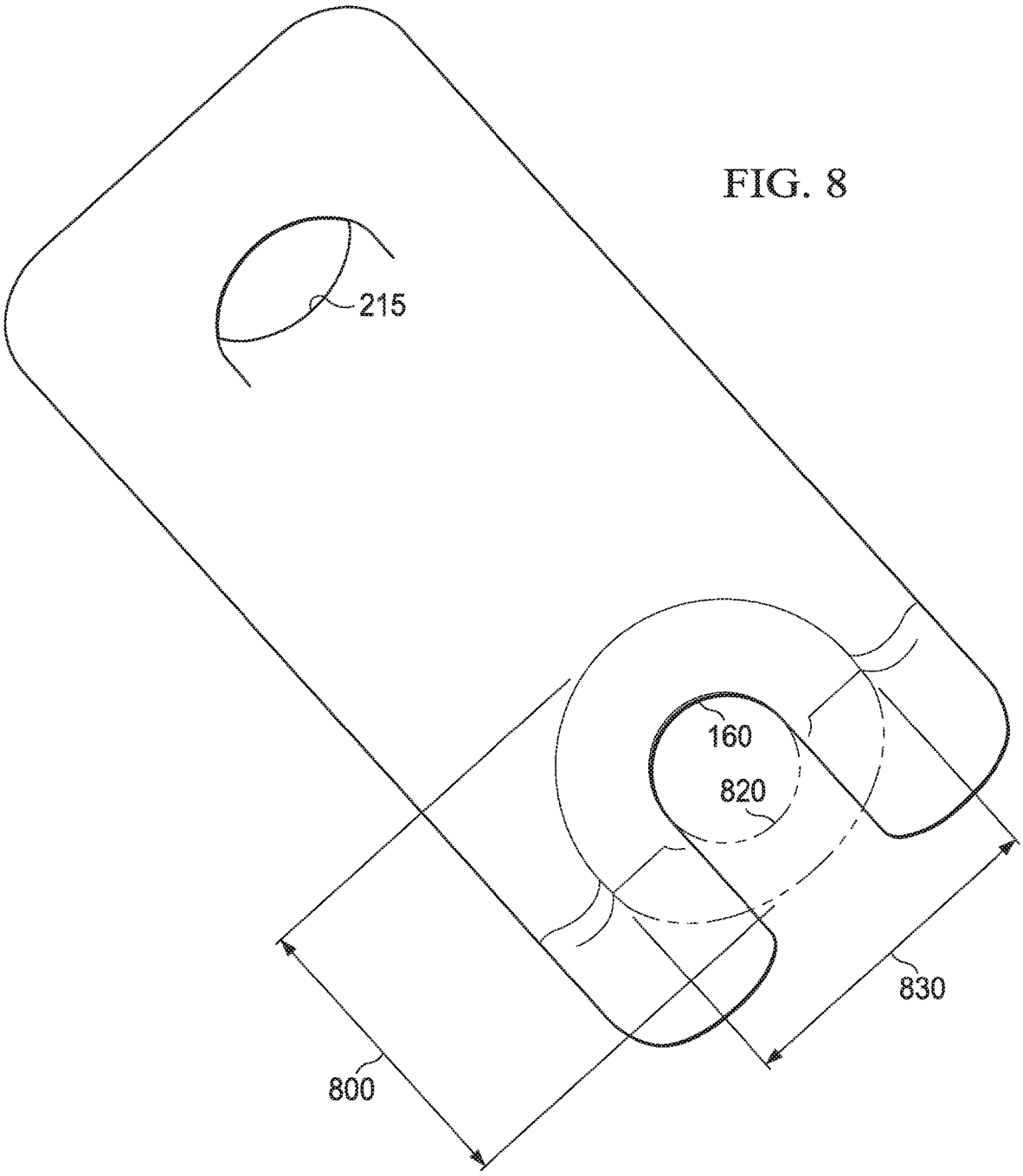
FIG. 8 is a detailed view of the spike claw puller of FIG. 1 taken at view angle 8-8 of FIG. 7.

FIG. 8 is a detailed view of the spike claw puller 100 at view angle 8-8. The cradle distance 800 may be about 41.8 mm or 1.645 inches. The diameter 820 of an inner end of the jaw opening 160 may be about 20.6 mm or 0.81 inches which may correspond to the width of a corresponding portion of a rail spike 107. The width 830 of the cradle 130 may be about 46 mm or 1.81 inches.

Figure 9:
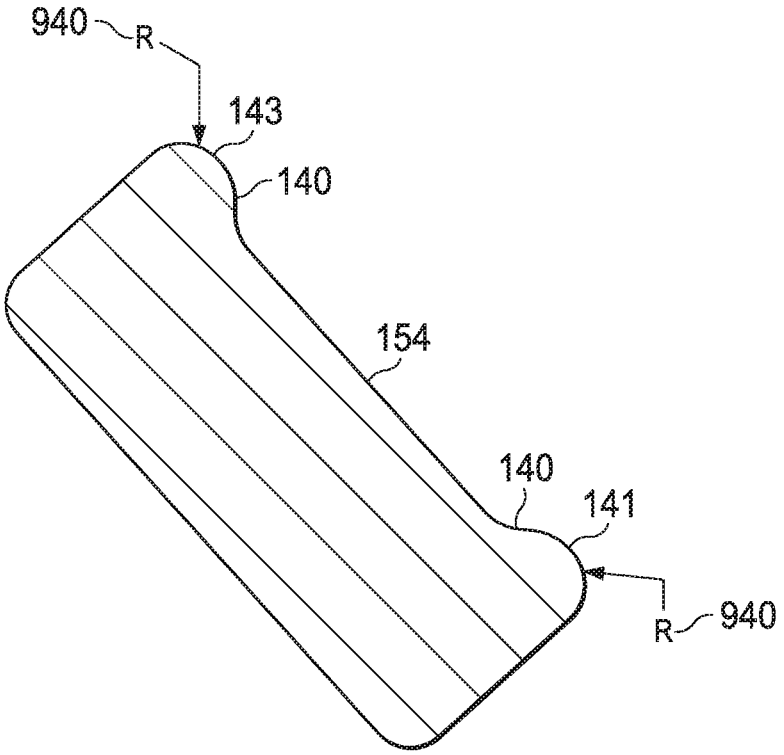
FIG. 9 is a cross-sectional view of the spike claw puller of FIG. 1 taken at section 9-9 of FIG. 7.

FIG. 9 is a cross-sectional view of the spike claw puller 100 at section 9-9 of FIG. 7. In some embodiments, each of the first and second ribs 141 and 143 has a rounding radius 940 of about 4.83 mm or 0.19 inches.

Figure 10:
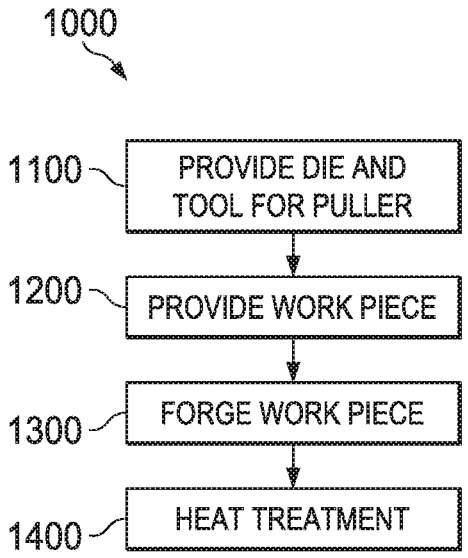
FIG. 10 is a flow chart illustrating an embodiment of a forging method for manufacturing an improved spike claw puller in accordance with this disclosure.

FIG. 10 is a flow chart for a forging method 1000 for manufacturing the spike claw puller 100. At step 1100, a forging die and a forging tool are provided for forging the spike claw puller 100. At step 1200, a work piece made of 4340 steel is provided, heated and then placed between the forging die and forging tool. In some embodiments, the work piece may include a higher nickel content than that of AISI 4340 steel. At step 1300, the work piece is forged into the shape defined by the forging die and forging tool. At step 1400, the forged work piece is heat treated using 42-46 Rc.

In the foregoing description of certain embodiments, specific terminology has been chosen for the sake of clarity. However, the disclosure is not intended to be limited to the specific terms selected, and it is to be understood that each specific term includes other technical equivalents which operate in a similar manner to accomplish a similar technical purpose. In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes some embodiments of the disclosure, and alterations, modifications, additions and/or changes can be made thereto without departing from the scope and spirit of the disclosed embodiments, the embodiments being illustrative and not restrictive.

Furthermore, the disclosure is not to be limited to the illustrated implementations, but to the contrary, is intended to cover various modifications and equivalent arrangements included within the spirit and scope of the disclosure. Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. A spike claw puller for pulling a rail spike, comprising:

a handle defining a through hole configured to couple to a rail spike pulling machine, the rail spike pulling machine operable to displace the spike claw puller to receive a rail spike between a jaw opening;

a body section defining a top surface, the body section comprising a first feeder tooth extending from the handle at a first lift angle and a second feeder tooth extending from the handle at the first lift angle, the first and second feeder teeth forming the jaw opening therebetween configured to receive the rail spike;

a first feeder extension extending from the first feeder tooth, the first feeder extension protruding above and forming a nonperpendicular second lift angle with a plane that is coplanar with the top surface; and a second feeder extension extending from the second feeder tooth, the second feeder extension protruding above and forming the nonperpendicular second lift angle with the plane, the first and second feeder extensions facilitating alignment with the rail spike.

2. The spike claw puller of claim 1, wherein each of the first and second feeder extensions include a support surface configured to support an underside of a head of the rail spike.

3. The spike claw puller of claim 1, wherein the first feeder extension comprises a first slanted leading edge and the second feeder extension comprises a second slanted leading edge.

4. The spike claw puller of claim 1, wherein the first feeder extension comprises a first rounded surface arcing from a first leading portion of the first feeder extension to a side wall of the jaw opening, and the second feeder extension comprises a second rounded surface arcing from a second leading portion of the second feeder extension to a second side wall of the jaw opening.

5. The spike claw puller of claim 4, wherein each of the first and second rounded surfaces have a radius of 0.5 inches.

6. The spike claw puller of claim 1, wherein the first feeder tooth together with the first feeder extension define a first inner ledge and the second feeder tooth together with the second feeder extension define a second inner ledge, the first and second inner ledges being configured to contact a substantial entirety of an underside of a head of the rail spike.

7. The spike claw puller of claim 1, wherein the first feeder tooth further comprises a first rib and the second feeder tooth further comprises a second rib, wherein the first rib extends from the first feeder extension to the handle and the second rib extends from the second feeder extension to the handle.

8. The spike claw puller of claim 1, wherein the first and second feeder teeth have a thickness greater than a thickness of the handle.

9. The spike claw puller of claim 1, wherein the rail spike conforms to ASTM A65 standard.

10. The spike claw puller of claim 1, wherein the jaw opening comprises a first inner side wall and a second inner side wall opposite from the first inner side wall, wherein the first inner side wall is parallel to the second inner side wall.

11. The spike claw puller of claim 1, wherein the rail spike pulling machine is a Nordco rail spike pulling machine.

12. The spike claw puller of claim 1, wherein the first lift angle being approximately 138 degrees and the nonperpendicular second lift angle being approximately 120 degrees.

13. The spike claw puller of claim 1, wherein the jaw opening is delimited by a lower arcuate edge, an upper arcuate edge, and an arcuate cradle surface disposed therebetween.

14. A claw puller for pulling rail spikes, comprising:

a handle defining a through hole configured to couple to a rail spike pulling machine, the handle having a planar face delimited by a transition surface disposed at an intersection of the handle with a body section;

the body section including a pair of feeder teeth extending from the transition surface and defining a jaw therebetween, a top surface of the body section forming a first lift angle with the planar face of the handle, the body section including a cradle having a tapered arcuate surface; and a pair of feeder extensions extending from respective feeder teeth and protruding above and forming a nonperpendicular second lift angle with a plane that is coplanar with the top surface of the body section, each one of the pair of feeder extensions facilitating alignment with a rail spike.

15. The claw puller of claim 14, wherein the first lift angle is approximately 138 degrees and the nonperpendicular second lift angle is approximately 120 degrees.

16. The claw puller of claim 14, wherein each of the pair of feeder extensions is configured such that a distal end of the respective feeder extension extends to be at least even with an end of a rail spike head during use.

17. The claw puller of claim 14, wherein each feeder tooth and feeder extension together defines a ledge extending from the cradle towards an end of the respective feeder extension, each ledge being configured to contact a substantial entirety of an underside of a spike head during use.

18. The claw puller of claim 14, wherein a radius of the transition surface is approximately 0.75 inches.

* * * * *